US010522083B1

(12) United States Patent
Li et al.

(10) Patent No.: US 10,522,083 B1
(45) Date of Patent: Dec. 31, 2019

(54) ORGANIC LIGHT-EMITTING DIODE (OLED) DRIVING CIRCUIT AND ACTIVE-MATRIX ORGANIC LIGHT-EMITTING DIODE (AMOLED) DISPLAY PANEL

(71) Applicant: Wuhan China Star Optoelectronics Semiconductor Display Technology Co., Ltd., Wuhan, Hubei (CN)

(72) Inventors: Xue Li, Guangdong (CN); Xueshun Hou, Guangdong (CN)

(73) Assignee: WUHAN CHINA STAR OPTOELECTRONICS SEMICONDUCTOR DISPLAY TECHNOLOGY CO., LTD., Wuhan, Hubei (CN)

( * ) Notice: Subject to any disclaimer, the term of this patent is extended or adjusted under 35 U.S.C. 154(b) by 0 days.

(21) Appl. No.: 16/095,868

(22) PCT Filed: Aug. 29, 2018

(86) PCT No.: PCT/CN2018/102958
§ 371 (c)(1),
(2) Date: Oct. 23, 2018

(30) Foreign Application Priority Data

Jul. 27, 2018 (CN) ..... 2018 1 0841303

(51) Int. Cl.
*G09G 3/3233* (2016.01)
*G09G 3/3291* (2016.01)

(52) U.S. Cl.
CPC ..... *G09G 3/3233* (2013.01); *G09G 3/3291* (2013.01); *G09G 2320/0233* (2013.01)

(58) Field of Classification Search
CPC ..... G09G 3/3233; G09G 3/3258; G09G 2300/0842; G09G 2310/0251
See application file for complete search history.

(56) References Cited

U.S. PATENT DOCUMENTS

2014/0111563 A1* 4/2014 Hwang ..... G09G 3/003 345/691
2016/0148573 A1* 5/2016 Lai ..... G09G 3/3233 345/205

(Continued)

FOREIGN PATENT DOCUMENTS

CN 103700342 A 4/2014
CN 104157240 A 11/2014
CN 105185305 A 12/2015

OTHER PUBLICATIONS

International search report dated Apr. 2, 2019 from corresponding application No. PCT/CN2018/102958.

*Primary Examiner* — Shaheda A Abdin
(74) *Attorney, Agent, or Firm* — Leong C. Lei

(57) ABSTRACT

The present disclosure relates to an organic light-emitting diode (OLED) driving circuit, including: a switch thin film transistor (TFT), a driving TFT, a storage capacitor, a third TFT, a sixth TFT, an OLED, and an elimination module. A gate of the third TFT is configured to receive reset signals, a first end of the third TFT is configured to receive a reset voltage, and a second end of the third TFT is electrically connected to the first node. A gate of the sixth TFT is configured to receive enabling signals, and a first end of the sixth TFT is electrically connected the second node. An elimination module is electrically connected to the first electrode of the storage capacitor and the first end of the driving TFT. The elimination module is configured to receive the data voltage and the power supply voltage.

20 Claims, 5 Drawing Sheets

(56) References Cited

U.S. PATENT DOCUMENTS

| | | | | |
|---|---|---|---|---|
| 2016/0155387 | A1* | 6/2016 | Kim | G09G 3/3291<br>345/76 |
| 2017/0270860 | A1* | 9/2017 | Wang | G09G 3/3233 |

* cited by examiner

ORGANIC LIGHT-EMITTING DIODE (OLED) DRIVING CIRCUIT AND ACTIVE-MATRIX ORGANIC LIGHT-EMITTING DIODE (AMOLED) DISPLAY PANEL

CROSS-REFERENCE TO RELATED APPLICATION

This application is a National Phase of International Application Number PCT/CN2018/102958, filed Aug. 29, 2018, and claims the priority of Chinese Patent Application No. 201810841303.4, entitled "ORGANIC LIGHT-EMITTING DIODE (OLED) DRIVING CIRCUIT AND ACTIVE-MATRIX ORGANIC LIGHT-EMITTING DIODE (AMOLED) DISPLAY PANEL", filed on Jul. 27, 2018, the disclosure of which is incorporated herein by reference in its entirety.

FIELD OF THE INVENTION

The present disclosure relates to a driving display field, and more particularly to an organic light-emitting diode (OLED) driving circuit and an active-matrix organic light-emitting diode (AMOLED) display panel.

BACKGROUND OF THE INVENTION

The organic light-emitting diode (OLED) display panels have been popular due to the attributes, such as thin thickness, light weight, low power-consuming, wide viewing angle, wide color gamut, and high contract. The OLED display panel includes passive-matrix organic light-emitting diode (PMOLED) display panels and active-matrix organic light-emitting diode (AMOLED) display panels. FIG. 1 is a conventional OLED driving circuit of the AMOLED, the OLED driving circuit is configured to drive the OLED. The OLED driving circuit includes a switch thin film transistor (TFT) T2, a driving TFT T1, and a storage capacitor Cst. The structure of the OLED driving circuit is referred to as a 2T1C structure. The gate of the switch TFT T2 is configured to receive the scanning signals at the n-th level Scan (n). The drain of the switch TFT T2 is configured to receive the data voltage Vdata. The source of the switch TFT T2 is connected to the gate of the driving TFT T1. The scanning signals at the n-th level Scan (n) are configured to control the source and the drain of the switch TFT T2 to turn on or turn off. When the source and the drain of the switch TFT T2 are turned on by the scanning signals at the n-th level Scan (n), the data voltage Vdata is transmitted to the gate of the driving TFT T1. The source of the driving TFT T1 is connected to a power supply voltage VDD. The power supply voltage VDD is configured to be the high potential voltage. The drain of the driving TFT T1 is connected to the positive end of the OLED. The negative end of the OLED is connected to a low potential voltage VSS. The two sides of the storage capacitor Cst are respectively connected to the gate and the drain of the driving TFT T1. The current passing through the OLED is configured to be as $I_{OLED}=k(V_{gs}-V_{th})^2$. "$I_{OLED}$" indicates the current passing through the OLED and is also referred to as "the driving current of the OLED". "k" indicates the current amplification coefficient of the driving TFT T1, which is determined by the self-characteristic of the driving TFT T1. "$V_{gs}$" indicates the voltage between the gate and the source of the driving TFT T1. "$V_{th}$" indicates the threshold voltage of the driving TFT T1. It can be seen that the driving current of the OLED is related to the threshold voltage of the driving TFT T1. Due to the threshold voltage $V^{th}$ may easily drift, the driving current $I_{OLED}$ of the OLED may be changed. The change of the driving current $I_{OLED}$ of the OLED may cause the disorder of luminous brightness and may reduce the image quality of the AMOLED display panel.

SUMMARY OF THE INVENTION

The present disclosure relates to an organic light-emitting diode (OLED) driving circuit and an active-matrix organic light-emitting diode (AMOLED) display panel capable of solving the problem of the change of the driving current, which is caused by the drift of the threshold voltage of the driving thin film transistor (TFT).

In one aspect, the present disclosure relates to An organic light-emitting diode (OLED) driving circuit, including: a switch thin film transistor (TFT), wherein a gate of the switch TFT is configured to receive scanning signals, a first end of the switch TFT is electrically connected to a first node, and a second end of the switch TFT is electrically connected to a second node; a driving TFT, wherein a first end of the driving TFT is configured to receive a power supply voltage, a gate of the driving TFT is electrically connected to the first node, and a second end of the driving TFT is electrically connected to the second node; a storage capacitor, wherein a first electrode of the storage capacitor is configured to receive a data voltage, and a second electrode of the storage capacitor is electrically connected to the first node; a third TFT, wherein a gate of the third TFT is configured to receive reset signals, a first end of the third TFT is configured to receive a reset voltage, and a second end of the third TFT is electrically connected to the first node; a sixth TFT, wherein a gate of the sixth TFT is configured to receive enabling signals, and a first end of the sixth TFT is electrically connected the second node; an OLED, wherein a positive end of the OLED is electrically connected to a second end of the sixth TFT, and a negative end of the OLED is loaded with a low potential voltage; and an elimination module being electrically connected to the first electrode of the storage capacitor and the first end of the driving TFT, wherein the elimination module is configured to respectively receive the data voltage and the power supply voltage, and the elimination module, the third TFT, and the sixth TFT are cooperatively configured to eliminate a change of a driving current passing through the OLED, wherein the change is caused by a drift of a threshold voltage of the driving TFT.

The scanning signals are configured to be the scanning signals at a n-th level, and "n" is an integral greater than or equal to 2.

The elimination module includes a fourth TFT and a fifth TFT, a gate of the fourth TFT is configured to receive reconfiguring signals, a first end of the fourth TFT is electrically connected to the first electrode of the storage capacitor, a second end of the fourth TFT is electrically connected to the first end of the driving TFT, a gate of the fifth TFT is configured to receive the scanning signals at a (n−1)-th level, a first end of the fifth TFT is configured to receive the data voltage, and a second end of the fifth TFT is electrically connected to the first electrode of the storage capacitor.

The reconfiguring signals are configured to be the same with the scanning signals at the (n−1)-th level; during a reset period, the third TFT and the fourth TFT are turned on, the first electrode of the storage capacitor is configured to store the power supply voltage, the second electrode of the storage capacitor is configured to store the reset voltage, and the driving TFT is turned on; during a compensation voltage period, the fourth TFT and the switch TFT are turned on, and the driving TFT is turned off when a voltage difference between the gate and the first end of the driving TFT is equal to the threshold voltage; during a writing period, the fifth TFT is turned on, and the data voltage is transmitted to the first electrode of the storage capacitor during an emitting period, the sixth TFT is turned on, and the OLED is configured to illuminate.

The switch TFT, the driving TFT, the third TFT, the fifth TFT, and the sixth TFT are P-type TFTs, and the fourth TFT is a N-type TFT.

The elimination module comprises a seventh TFT and an eighth TFT, the first end of the driving TFT is configured to receive the power supply voltage via the seventh TFT, a gate of the seventh TFT is configured to receive the enabling signals, a first end of the seventh TFT is configured to receive the power supply voltage, a second end of the seventh TFT is electrically connected to the first end of the driving TFT, a gate of the eighth TFT is configured to receive the scanning signals at the n-th level, a first end of the eighth TFT is configured to receive a reference voltage, and a second end of the eighth TFT is electrically connected to the first end of the driving TFT.

The reconfiguring signals are configured to be the enabling signals; during a reset period, the third TFT and the fifth TFT are turned on, the first electrode of the storage capacitor is configured to store the data voltage, and the second electrode of the storage capacitor is configured to store the reset voltage; during a compensation voltage period, the fifth TFT, the switch TFT, the driving TFT, and the eighth TFT are turned on, and the driving TFT is turned off when a voltage difference between the gate and the first end of the driving TFT is equal to the threshold voltage; during a writing period and an emitting period, the seventh TFT, the fourth TFT, and the sixth TFT are turned on, and the OLED is configured to illuminate.

The switch TFT, the driving TFT, the third TFT, the fourth TFT, the fifth TFT, the sixth TFT, the seventh TFT, and the eighth TFT are P-type TFTs.

The reset period, the compensation threshold voltage period, the writing period, and the emitting period are within one cycle of the OLED driving circuit.

The reset period, the compensation threshold voltage period, the writing period, and the emitting period are within one cycle of the OLED driving circuit.

The first ends of the driving TFT, the switch TFT, the third TFT, and the sixth TFT are configured to be sources, and the second ends of the driving TFT, the switch TFT, the third TFT, and the sixth TFT are configured to be drains; or the first ends of the driving TFT, the switch TFT, the third TFT, and the sixth TFT are configured to be the drains, and the second ends of the driving TFT, the switch TFT, the third TFT, and the sixth TFT are configured to be the sources.

In another aspect, the present disclosure further relates to an active-matrix organic light-emitting diode (AMOLED) display panel, including the OLED driving circuit described in above.

In view of the above, the OLED driving circuit includes the third TFT, the sixth TFT, and the elimination module. The third TFT, the sixth TFT, and the elimination module are configured to eliminate the change, caused by the drift of the threshold voltage of the driving TFT, of the driving current passing through the OLED. By the configuration of the third TFT, the sixth TFT, and the elimination module, the threshold voltage of the driving TFT may not be calculated in the calculation formula of the driving current. As such, the driving current may not be affected by the drift of the threshold voltage of the driving TFT, the driving current may be stable, the luminous brightness of the OLED may be uniform, and the image quality of the AMOLED display panel may be improved.

BRIEF DESCRIPTION OF THE DRAWINGS

In order to more clearly illustrate the embodiments of the present invention or prior art, the following figures will be described in the embodiments are briefly introduced. It is obvious that the drawings are merely some embodiments of the present disclosure, those of ordinary skill in this field can obtain other figures according to these figures without paying the premise.

DETAILED DESCRIPTION OF PREFERRED EMBODIMENTS

The following descriptions for the respective embodiments are specific embodiments capable of being implemented for illustrations of the present invention with referring to appended figures. The described embodiments are only a part of the embodiments of the disclosure, and are not all of the embodiments. All other embodiments obtained by those skilled in the art based on the embodiments of the present disclosure without creative efforts are within the scope of the present invention.

The terms "comprising" and "including", and any variations thereof, appearing in the specification, the claims, and the drawings are intended to cover a non-exclusive inclusion. For example, a process, a method, a system, a product, or device that includes a series of steps or units is not limited to the listed steps or units, but also includes other steps or units not listed, or other steps or units inherent to the process, the method, the product, or the device. Moreover, the terms "first", "second", "third", and so on, are used to distinguish different objects, and are not intended to describe a particular order.

Figure 1:
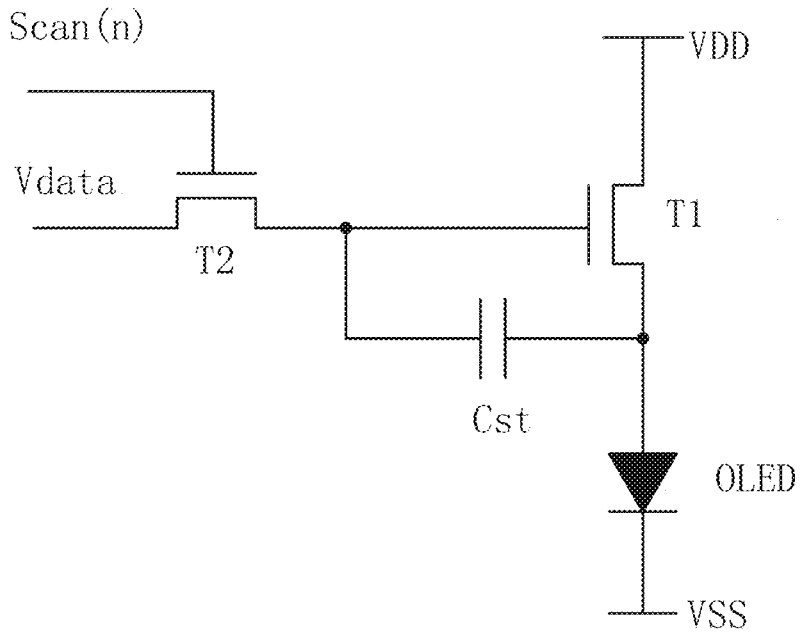
FIG. 1 is a diagram illustrating a conventional organic light-emitting diode (OLED) driving circuit.
Figure 2:
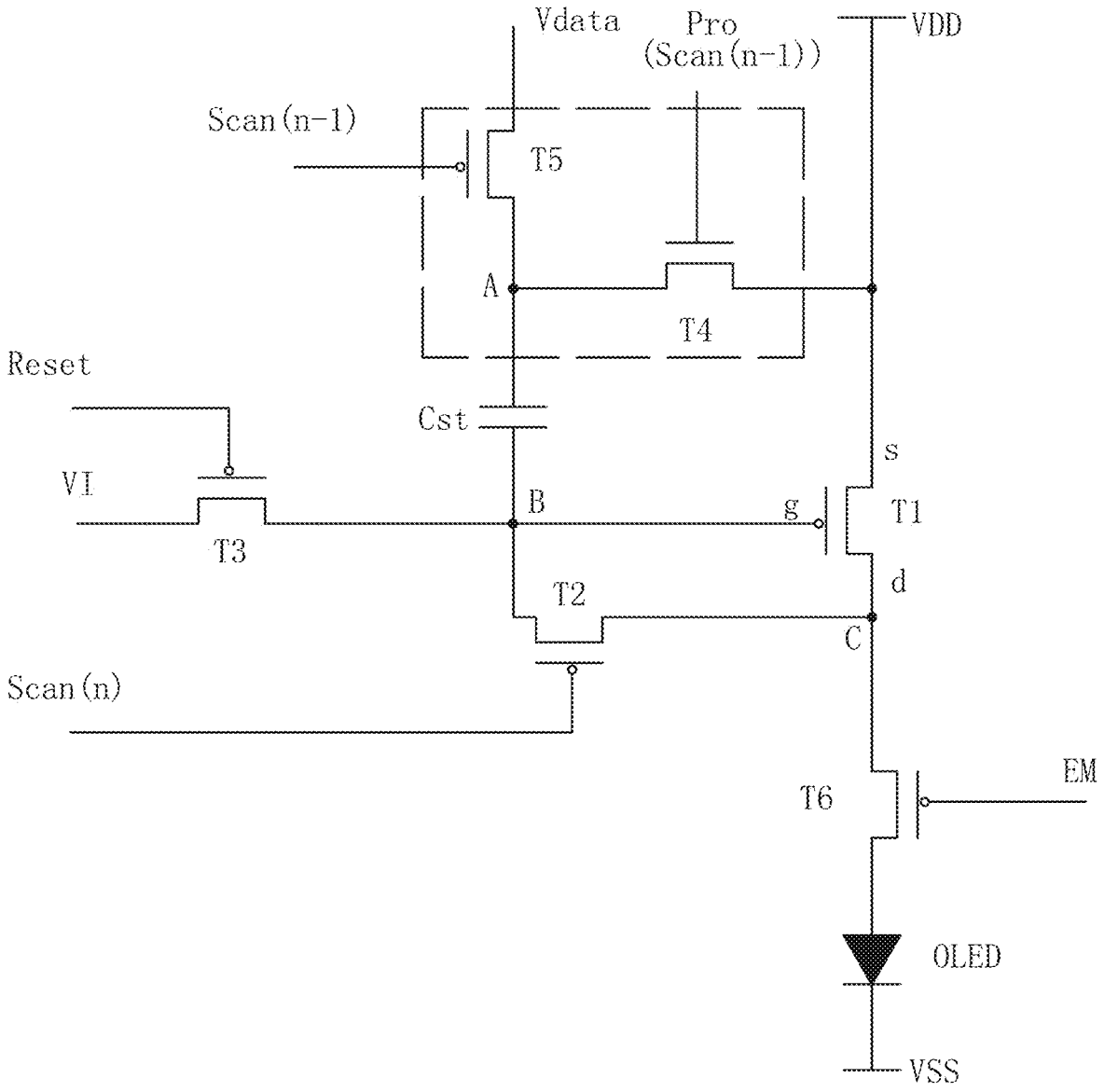
FIG. 2 is a schematic view of an OLED driving circuit in accordance with one embodiment of the present disclosure.

In one aspect, the present disclosure relates an organic light-emitting diode (OLED) driving circuit. Referring to FIG. 2, the OLED driving circuit includes an OLED, a storage capacitor Cst, a driving thin film transistor (TFT) T1, and a switch TFT T2. In one example, the OLED is configured to illuminate. A first electrode of the storage capacitor Cst is configured to receive a data voltage Vdata, and a second electrode of the storage capacitor Cst is electrically connected to a first node "B". A first end of the switch TFT T2 is electrically connected to the first node "B", and a second end of the switch TFT T2 is electrically connected to a second node "C". A gate of the switch TFT T2 is configured to receive scanning signals. The scanning signals are configured to be the scanning signals at a n-th level Scan (n), and "n" is an integral greater than or equal to 2, such as 2, 3, 4, 5, 6, 7, 8, 9, 10, and so on. A first end of the driving TFT T1 is configured to receive a power supply voltage VDD. In one example, the power supply voltage VDD is configured to be a high potential voltage. A second end of the driving TFT T1 is electrically connected to the second node "C". A gate of the driving TFT T1 is electrically connected to the first node "B". A positive end of the OLED is electrically connected to the second node "C" indirectly, and a negative end of the OLED is loaded with a low potential voltage VSS. In one example, the first end of the switch TFT T2 and the first end of the driving TFT T1 are configured to be sources, and the second end of the switch TFT T2 and the second end of the driving TFT T1 are configured to be drains. In another example, the first end of the switch TFT and the first end of the driving TFT are configured to be the drains, and the second end of the switch TFT T2 and the second end of the driving TFT T1 are configured to be the sources.

In order to eliminate a change, caused by an inference of a drift of a threshold voltage $V_{th}$ of the driving TFT T1 on a driving current passing through the OLED, of luminous brightness of the OLED. In one example, the OLED driving circuit may further include a third TFT T3, a sixth TFT T6, and an elimination module (the portion marked by the dashed box in FIG. 2). A gate of the third TFT T3 is configured to receive reset signals Reset. A first end of the third TFT T3 is configured to receive a reset voltage VI, and the reset voltage VI is configured to be at a low level. A second end of the third TFT T3 is electrically connected to the first node "B". As such, the second end of the third TFT T3 is electrically connected to a second electrode of the storage capacitor Cst, the first end of the switch TFT T2, and the gate of the driving TFT T1. A gate of the sixth TFT T6 is configured to receive enabling signals EM. A first end of the sixth TFT T6 is electrically connected the second node "C", and a second end of the sixth TFT T6 is electrically connected to a positive end of the OLED. The driving TFT T1 is electrically connected the positive end of the OLED indirectly. Specifically, the driving TFT T1 is electrically connected to the positive end of the OLED via the sixth TFT T6. The elimination module is electrically connected to the first electrode of the storage capacitor Cst and the first end of the driving TFT T1 respectively The elimination module is configured to receive the data voltage Vdata and the power supply voltage VDD. The elimination module, the third TFT, and the sixth TFT is cooperatively configured to eliminate the change of the driving current passing through the OLED, wherein the change is caused by the drift of the threshold voltage of the driving TFT T1.

Specifically, the elimination module may include a fourth TFT T4 and a fifth TFT T5. A gate of the fourth TFT T4 is configured to receive reconfiguring signals "Pro". In one example, the reconfiguring signals "Pro" are configured to be the scanning signals at a (n−1)-th level Scan (n−1). A first end of the fourth TFT T4 is electrically connected to the first electrode of the storage capacitor Cst. A second end of the fourth TFT T4 is electrically connected to the first end of the driving TFT T1. A gate of the fifth TFT T5 is configured to receive the scanning signals at the (n−1)-th level Scan (n−1). A first end of the fifth TFT T5 is configured to receive the data voltage Vdata. A second end of the fifth TFT T5 is electrically connected to the first electrode of the storage capacitor Cst. As such, the first electrode of the storage capacitor Cst is configured to receive the data voltage via the fifth TFT T5 and to receive the power supply voltage VDD via the fourth TFT T4. In one example, the first ends of the third TFT T3, the fourth TFT T4, the fifth TFT T5, and the sixth TFT T6 are configured to be the sources, and the second ends of the third TFT T3, the fourth TFT T4, the fifth TFT T5, and the sixth TFT T6 are configured to be the drains. In another example, the first ends of the third TFT T3, the fourth TFT T4, the fifth TFT T5, and the sixth TFT T6 are configured to be the drains, and the second ends of the third TFT T3, the fourth TFT T4, the fifth TFT T5, and the sixth TFT T6 are configured to be the sources.

In one example, the switch TFT T2, the driving TFT T1, the third TFT T3, the fifth TFT T5, and the sixth TFT T6 are P-type TFTs, and the fourth TFT T4 is a N-type TFT.

Figure 3:
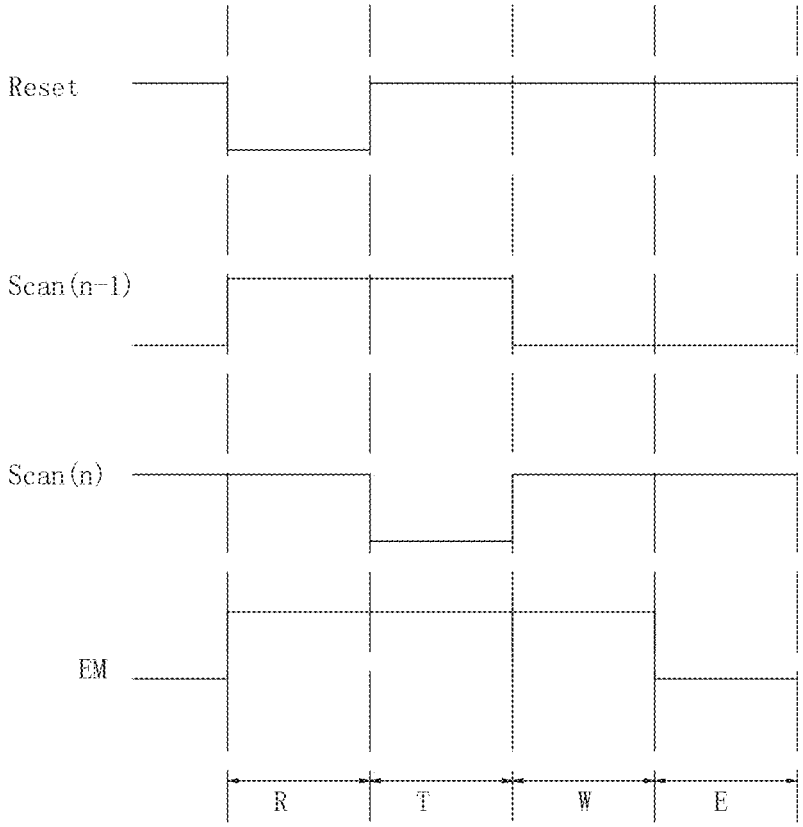
FIG. 3 is a timing diagram of the OLED driving circuit in accordance with one embodiment of the present disclosure.

In one example, the OLED in the OLED driving circuit is configured to illuminate in periodic, and one cycle of the OLED driving circuit includes a reset period, a compensation threshold voltage period, a writing period, and an emitting period. Referring to FIG. 3, the driving of the OLED driving circuit is described in below with reference to FIG. 2 and FIG. 3.

In one example, during the reset period, the reset signals Reset are configured to be at the low level, the third TFT T3 is turned on, and the reset voltage VI is transmitted to the first node "B". That is, the reset voltage VI is transmitted to the gate of the driving TFT T1, the second electrode of the storage capacitor Cst, and the first end of the switch TFT T2. As such, a gate voltage Vg of the driving TFT T1 is equal to the reset voltage VI, i.e., Vg=VI, the driving TFT T1 is turned on, and the reset voltage VI is stored at the second electrode of the storage capacitor Cst. The scanning signals at the (n−1)-th level are configured to be at a high level, the fourth TFT T4 is turned on, and the power supply voltage VDD is transmitted to the first electrode of the storage capacitor Cst. A connection node between the fourth TFT T4 and the storage capacitor Cst is configured to be a node "A", and a voltage VA of the node "A" is equal to the power supply voltage VDD, i.e., VA=VDD. The power supply voltage VDD is stored at the first electrode of the storage capacitor Cst, and a voltage Vs of the first end of the driving TFT T1 is equal to the power supply voltage VDD, i.e., Vs=VDD.

In one example, during the compensation threshold voltage period, the scanning signals at the (n−1)-th level Scan (n−1) are configured to be at the high level, the fourth TFT T4 is turned on, such that VA=VDD and Vs=VDD. The scanning signals at the n-th level Scan (n) are configured to be at the low level, such that the switch TFT T2 is turned on. The driving TFT T1 is turned on due to the gate voltage Vg is equal to the reset voltage VI, i.e., Vs=VI, during the reset period. As such, the threshold voltage Vth of the driving TFT T1 may be obtained during the compensation threshold voltage period. Specifically, the driving TFT T1 is turned on until a voltage difference Vsg between the gate and the first end of the driving TFT T1 is equal to the threshold voltage, i.e. Vsg=|Vth|, as such the threshold voltage Vth of the driving TFT T1 is obtained. In one example, the driving TFT T1 is the P-type TFT, the driving TFT T1 is turned off when Vsg=|Vth|. That is, the driving TFT T1 is turned off when the voltage difference between the gate and the first end of the driving TFT T1 is equal to the threshold voltage. As such, Vs-Vg=|Vth|, Vg=Vs−|Vth|, and Vg=VDD−|Vth|.

In one example, during the writing period, the scanning signals at the (n−1)-th level Scan (n−1) are configured to be at the low level, the fourth TFT T4 is turned off, and the fifth TFT T5 is turned on. A voltage of the first electrode of the storage capacitor Cst is suddenly transformed from the power supply voltage VDD into the data voltage Vdata, i.e., VA=Vdata. A voltage of the second electrode of the storage capacitor Cst is suddenly transformed into VDD-|Vth|−

(VDD−Vdata) by a coupling effect of the storage capacitor Cst. That is, the voltage of the second electrode of the storage capacitor Cst is suddenly transformed into Vdata-|Vth|, and a voltage VB of the first node "B" is equal to Vdata-|Vth|, i.e., VB=Vdata−|Vth|. As such, the gate voltage Vg of the driving TFT T1 is equal to Vdata−|Vth|, i.e., Vg=Vdata−|Vth|, and the gate voltage Vg is stored at the second end of the storage capacitor Cst.

In one example, during the emitting period, the enabling signals EM are configured to be at the low level, the sixth TFT T6 is turned on, the driving current $I_{OLED}$ may pass through the OLED, and the OLED may be able to illuminate. The calculation formula of the driving current is in below.

$$
\begin{aligned}
I_{OLED} &= k(V_{gs} - |Vth|)^2 \\
&= k(Vs - Vg - |Vth|)^2 \\
&= k(VDD - (Vdata - |Vth|) - |Vth|)^2 \\
&= k(VDD - Vdata)^2
\end{aligned}
$$

"k" indicates a current amplification coefficient of the driving TFT T1. "VDD" indicates the power supply voltage. "Vdata" indicates the data voltage.

According to the calculation formula of the driving current $I_{OLED}$, it can be seen that the threshold voltage Vth is not calculated in the calculation formula. As such, the driving current may not be affected by the drift of the threshold voltage Vth of the driving TFT T1, the driving current may be stable, the luminous brightness of the OLED may be uniform, the image quality of an active-matrix organic light-emitting diode (AMOLED) display panel may be improved, and the problem of the "non-expecting illumination" of the OLED occurred in the reset period may be solved.

In another example, the switch TFT T2, the driving TFT T1, the third TFT T3, the fifth TFT T5, and the sixth TFT T6 are the N-type TFTs, and the fourth TFT T4 is the P-type TFT. The reset signals Reset, the scanning signals at the (n−1)-th Scan (n−1), the scanning signals at the n-th level Scan (n), and a voltage of the enabling signals EM are required to be reversed. That is, positions of the high level and the low level shown in FIG. 3 are required to be reversed.

In another aspect, the present disclosure further relates to the AMOLED display panel, including the OLED driving circuit described in above.

According to the calculation formula described in above, the driving current $I_{OLED}$ is related to the power supply voltage VDD. When the OLED away from the power supply voltage VDD is configured to receive the power supply voltage VDD, the power supply voltage VDD needs to be transmitted over a long distance. The power supply voltage VDD may be reduced, causing the drift of the driving current $I_{OLED}$, which is referred to as "IR drop" by the person skilled in the art. In order to solve this problem, the present disclosure provides another examples.

Figure 4:
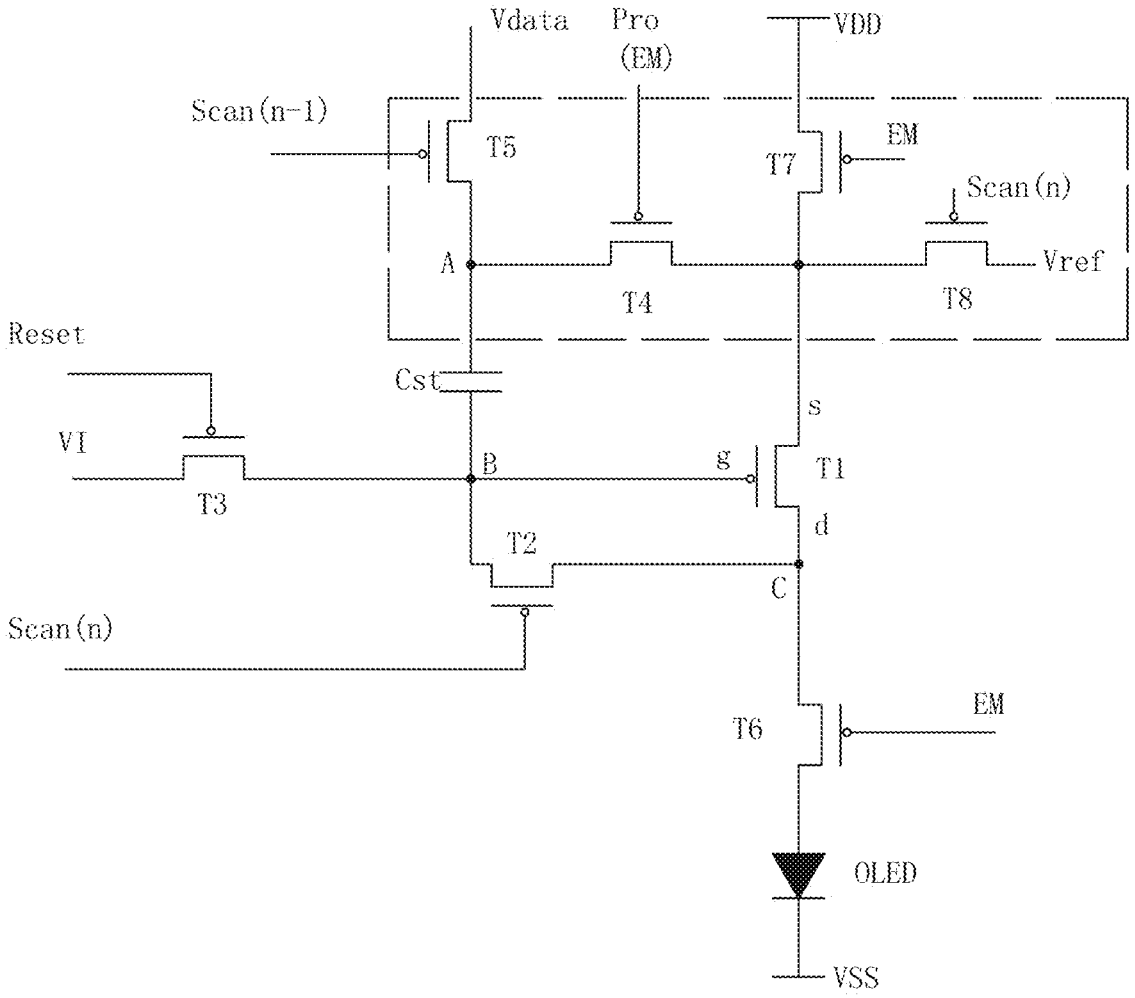
FIG. 4 is a schematic view of an OLED driving circuit in accordance with another embodiment of the present disclosure.

Referring to FIG. 4, a circuit structure shown in FIG. 4 is similar to that of in FIG. 2, and the same symbol indicates the same component. The difference between this example and the previous example resides in the elimination module.

Referring to FIG. 4, the elimination module may further include a seventh TFT T7 and an eighth TFT T8. The first end of the driving TFT T1 is configured to receive the power supply voltage VDD via the seventh TFT T7. Specifically, a gate of the seventh TFT T7 is configured to receive the enabling signals EM. A first end of the seventh TFT T7 is configured to receive the power supply voltage VDD. A second end of the seventh TFT T7 is electrically connected to the first end of the driving TFT T1. A gate of the eighth TFT T8 is configured to receive the scanning signals at the n-th level Scan (n). A first end of the eighth TFT T8 is configured to receive a reference voltage Vref. A second end of the eighth TFT T8 is electrically connected to the first end of the driving TFT T1. In one example, the reconfiguring signals "Pro" may be the same with the enabling signals EM. That is, the two signals may be the same. In one example, the first ends of the seventh TFT T7 and the eighth TFT T8 are configured to be the sources, and the second ends of the seventh TFT T7 and the eighth TFT T8 are configured to be the drains. In another example, the first ends of the seventh TFT T7 and the eighth TFT T8 are configured to be the drains, and the second ends of the seventh TFT T7 and the eighth TFT T8 are configured to be the sources.

In one example, the switch TFT T2, the driving TFT T1, the third TFT T3, the fourth TFT T4, the fifth TFT T5, the sixth TFT T6, the seventh TFT T7, and eighth TFT T8 are the P-type TFTs.

Figure 5:
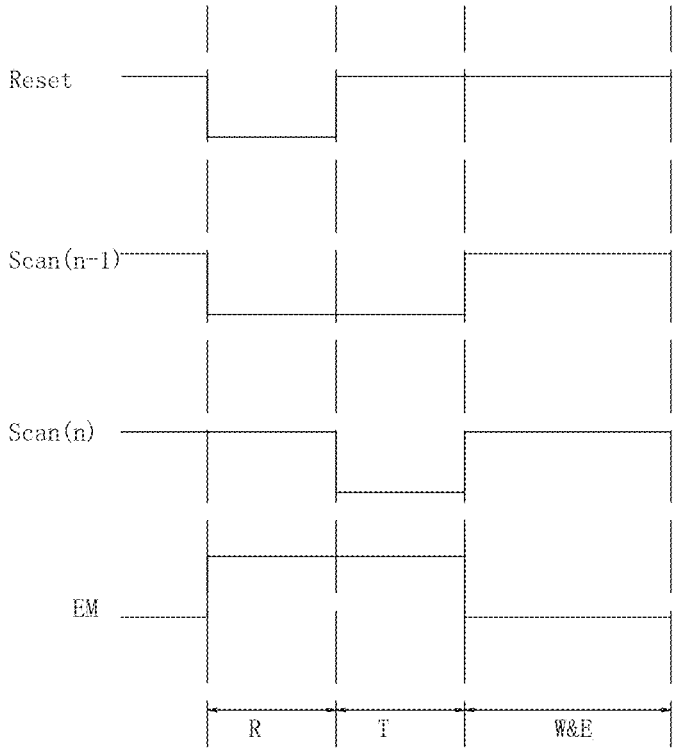
FIG. 5 is a timing diagram of the OLED driving circuit in accordance with another embodiment of the present disclosure.

In one example, the OLED in the OLED driving circuit is configured to illuminate in periodic, and one cycle of the OLED driving circuit includes the reset period "R", the compensation threshold voltage period "T", the writing period "W", and the emitting period "E". Referring to FIG. 5, the driving of the OLED driving circuit is described in below with reference to FIG. 4 and FIG. 5.

In one example, during the reset period "R", the reset signals Reset are configured to be at the low level, the third TFT T3 is turned on, and the reset voltage VI is transmitted to the first node "B". The voltage VB of the first node B is equal to the reset voltage VI, i.e., VB=BI. The reset voltage VI is transmitted to the gate of the driving TFT T1, the second electrode of the storage capacitor Cst, and the first end of the switch TFT T2. As such, the gate voltage Vg of the driving TFT T1 is equal to the reset voltage VI, and the reset voltage VI is stored at the second electrode of the storage capacitor Cst. The scanning signals at the (n−1)-th level are configured to be at the low level, the fifth TFT T5 is turned on, and the data voltage Vdata is transmitted to the first electrode of the storage capacitor Cst. A connection node between the fourth TFT T4, the fifth TFT T5, and the storage capacitor Cst is configured to be the node "A", and the voltage VA of the node "A" is equal to the data voltage Vdata, i.e., VA=VDD. The data voltage Vdata is stored at the first electrode of the storage capacitor Cst.

In one example, during the compensation threshold voltage period "T", the scanning signals at the (n−1)-th level Scan (n−1) are configured to be at the low level, the fifth TFT T5 is turned on, such that VA=Vdata. The scanning signals at the n-th level Scan (n) are configured to be at the low level, such that the switch TFT T2 and the eighth TFT T8 are turned on. When the eighth TFT T8 is turned on, the first end of the driving TFT T1 is configured to receive the reference voltage. The gate of the driving TFT T1 is maintained to be at the reset voltage, i.e., Vg=VI, the driving TFT T1 is turned on. The threshold voltage Vth of the driving TFT T1 may be obtained due to the switch TFT T2 is turned on. The driving TFT T1 is turned on until the voltage difference Vsg between the gate and the first end of the driving TFT T1 is equal to the threshold voltage Vth, i.e. Vsg=|Vth|, as such the threshold voltage Vth of the driving TFT T1 is obtained. In one example, the driving TFT T1 is the P-type TFT, and the driving TFT T1 is turned off when Vsg=|Vth|. That is, the driving TFT T1 is turned off when the voltage difference between the gate and the first end of the driving TFT T1 is equal to the threshold voltage. As such, Vs-Vg=|Vth|, Vg=Vs−|Vth|, and Vg=Vref−|Vth|.

In one example, during the writing period "W" and the emitting period "E", the driving circuit of the OLED is configured to receive the same signals. The enabling signals EM are configured to be at the low level, the fourth TFT T4, the sixth TFT T6, and the seventh TFT T7 is turned on. The scanning signals at the (n−1)-th level Scan (n−1) are configured to be at the high level, and the fifth TFT T5 is turned off. The voltage of the first electrode of the storage capacitor Cst is suddenly transformed into the data voltage VDD, i.e., VA=VDD. The voltage of the second electrode of the storage capacitor Cst is configured to be as Vref−|Vth|−(VDD−Vdata) by the coupling effect of the storage capacitor Cst. The voltage of the second electrode of the storage capacitor Cst is stored at the second electrode of the storage capacitor Cst. The voltage of the first node "B" is configured to be as VB=Vref−|Vth|+(VDD−Vdata). The sixth TFT T6, the seventh TFT T7, and the driving TFT T1 are turned on. A voltage of the first end of the driving TFT T1 may be the power supply voltage VDD, i.e., Vs=VDD. The calculation formula of the driving current $_{IOLED}$ passing through the OLED is shown in below.

$$
\begin{aligned}
|_{OLED} &= k(V_{gs} - |Vth|)^2 \\
&= k(Vs - Vg - |Vth|)^2 \\
&= k(VDD - (Vref - |Vth|) + (VDD - Vdata) - |Vth|)^2 \\
&= k(Vdata - Vref)^2
\end{aligned}
$$

"k" indicates the current amplification coefficient of the driving TFT T1. "Vdata" indicates the data voltage. "Vref" indicates the reference voltage.

According to the calculation formula of the driving current $I_{OLED}$, it can be seen that the threshold voltage Vth is not calculated in the calculation formula. As such, the driving current may not be affected by the drift of the threshold voltage Vth of the driving TFT T1, the driving current may be stable, the luminous brightness of the OLED may be uniform, the image quality of the AMOLED display panel may be improved, and the problem of the "non-expecting illumination" of the OLED occurred in the reset period may be solved. In addition, the power supply voltage VDD is also not calculated in the calculation formula of the driving current $I_{OED}$. As such, even if the power supply voltage VDD is reduced because the power supply voltage VDD is transmitted over a long distance, the problem of "IR drop" may not occur, and the driving current and the luminous brightness of the OLED may become more stable.

In another example, the switch TFT, the driving TFT, the third TFT, the fourth TFT, the fifth TFT, and the sixth TFT, the seventh TFT, and the eighth TFT are the N-type TFTs. The reset signals Reset, the scanning signals at the (n−1)-th Scan (n−1), the scanning signals at the n-th level Scan (n), and the voltage of the enabling signals EM are required to be reversed. That is, positions of the high level and the low level shown in FIG. 5 are required to be reversed.

It should be noted that the various embodiments in the present disclosure are described in a progressive manner, and each embodiment focuses on the differences each of the embodiments. The same portions between the various embodiments are mutually referred to. For the device embodiment, since it is basically similar to the method embodiment, the description is relatively simple, and the relevant portions can be referred to the description of the method embodiment.

In view of the above, the OLED driving circuit includes the third TFT, the sixth TFT, and the elimination module. The third TFT, the sixth TFT, and the elimination module are cooperatively configured to eliminate the change, caused by the drift of the threshold voltage of the driving TFT, of the driving current passing through the OLED. By the configuration of the third TFT, the sixth TFT, and the elimination module, the threshold voltage of the driving TFT may not be calculated in the calculation formula of the driving current. As such, the driving current may not be affected by the drift of the threshold voltage of the driving TFT, the driving current may be stable, the luminous brightness of the OLED may be uniform, and the image quality of the AMOLED display panel may be improved.

Above are embodiments of the present invention, which does not limit the scope of the present invention. Any equivalent amendments within the spirit and principles of the embodiment described above should be covered by the protected scope of the invention.

What is claimed is:

1. An organic light-emitting diode (OLED) driving circuit, comprising:

a switch thin film transistor (TFT), wherein a gate of the switch TFT is configured to receive scanning signals, a first end of the switch TFT is electrically connected to a first node, and a second end of the switch TFT is electrically connected to a second node;

a driving TFT, wherein a first end of the driving TFT is configured to receive a power supply voltage, a gate of the driving TFT is electrically connected to the first node, and a second end of the driving TFT is electrically connected to the second node;

a storage capacitor, wherein a first electrode of the storage capacitor is configured to receive a data voltage, and a second electrode of the storage capacitor is electrically connected to the first node;

a third TFT, wherein a gate of the third TFT is configured to receive reset signals, a first end of the third TFT is configured to receive a reset voltage, and a second end of the third TFT is electrically connected to the first node;

a sixth TFT, wherein a gate of the sixth TFT is configured to receive enabling signals, and a first end of the sixth TFT is electrically connected the second node;

an OLED, wherein a positive end of the OLED is electrically connected to a second end of the sixth TFT, and a negative end of the OLED is loaded with a low potential voltage; and an elimination module being electrically connected to the first electrode of the storage capacitor and the first end of the driving TFT, wherein the elimination module is configured to respectively receive the data voltage and the power supply voltage, and the elimination module, the third TFT, and the sixth TFT are cooperatively configured to eliminate a change of a driving current passing through the OLED, wherein the change is caused by a drift of a threshold voltage of the driving TFT.

2. The OLED driving circuit according to claim 1, wherein the scanning signals are configured to be the scanning signals at a n-th level, and "n" is an integral greater than or equal to 2.

3. The OLED driving circuit according to claim 2, wherein the elimination module comprises a fourth TFT and a fifth TFT, a gate of the fourth TFT is configured to receive reconfiguring signals, a first end of the fourth TFT is electrically connected to the first electrode of the storage capacitor, a second end of the fourth TFT is electrically connected to the first end of the driving TFT, a gate of the fifth TFT is configured to receive the scanning signals at a (n−1)-th level, a first end of the fifth TFT is configured to receive the data voltage, and a second end of the fifth TFT is electrically connected to the first electrode of the storage capacitor.

4. The OLED driving circuit according to claim 3, wherein the reconfiguring signals are configured to be the same with the scanning signals at the (n−1)-th level;

during a reset period, the third TFT and the fourth TFT are turned on, the first electrode of the storage capacitor is configured to store the power supply voltage, the second electrode of the storage capacitor is configured to store the reset voltage, and the driving TFT is turned on;

during a compensation voltage period, the fourth TFT and the switch TFT are turned on, and the driving TFT is turned off when a voltage difference between the gate and the first end of the driving TFT is equal to the threshold voltage;

during a writing period, the fifth TFT is turned on, and the data voltage is transmitted to the first electrode of the storage capacitor;

during an emitting period, the sixth TFT is turned on, and the OLED is configured to illuminate.

5. The OLED driving circuit according to claim 4, wherein the switch TFT, the driving TFT, the third TFT, the fifth TFT, and the sixth TFT are P-type TFTs, and the fourth TFT is a N-type TFT.

6. The OLED driving circuit according to claim 4, wherein the reset period, the compensation threshold voltage period, the writing period, and the emitting period are within one cycle of the OLED driving circuit.

7. The OLED driving circuit according to claim 3, wherein the elimination module comprises a seventh TFT and an eighth TFT, the first end of the driving TFT is configured to receive the power supply voltage via the seventh TFT, a gate of the seventh TFT is configured to receive the enabling signals, a first end of the seventh TFT is configured to receive the power supply voltage, a second end of the seventh TFT is electrically connected to the first end of the driving TFT, a gate of the eighth TFT is configured to receive the scanning signals at the n-th level, a first end of the eighth TFT is configured to receive a reference voltage, and a second end of the eighth TFT is electrically connected to the first end of the driving TFT.

8. The OLED driving circuit according to claim 7, wherein the reconfiguring signals are configured to be the enabling signals;

during a reset period, the third TFT and the fifth TFT are turned on, the first electrode of the storage capacitor is configured to store the data voltage, and the second electrode of the storage capacitor is configured to store the reset voltage;

during a compensation voltage period, the fifth TFT, the switch TFT, the driving TFT, and the eighth TFT are turned on, and the driving TFT is turned off when a voltage difference between the gate and the first end of the driving TFT is equal to the threshold voltage;

during a writing period and an emitting period, the seventh TFT, the fourth TFT, and the sixth TFT are turned on, and the OLED is configured to illuminate.

9. The OLED driving circuit according to claim 8, wherein the switch TFT, the driving TFT, the third TFT, the fourth TFT, the fifth TFT, the sixth TFT, the seventh TFT, and the eighth TFT are P-type TFTs.

10. The OLED driving circuit according to claim 8, wherein the reset period, the compensation threshold voltage period, the writing period, and the emitting period are within one cycle of the OLED driving circuit.

11. The OLED driving circuit according to claim 1, wherein the first ends of the driving TFT, the switch TFT, the third TFT, and the sixth TFT are configured to be sources, and the second ends of the driving TFT, the switch TFT, the third TFT, and the sixth TFT are configured to be drains; or the first ends of the driving TFT, the switch TFT, the third TFT, and the sixth TFT are configured to be the drains, and the second ends of the driving TFT, the switch TFT, the third TFT, and the sixth TFT are configured to be the sources.

12. An active-matrix organic light-emitting diode (AMOLED) display panel, comprising: an OLED driving circuit comprising:

a switch TFT, wherein a gate of the switch TFT is configured to receive scanning signals, a first end of the switch TFT is electrically connected to a first node, and a second end of the switch TFT T2 is electrically connected to a second node;

a driving TFT, wherein a first end of the driving TFT is configured to receive a power supply voltage, a gate of the driving TFT is electrically connected to the first node, and a second end of the driving TFT is electrically connected to the second node;

a storage capacitor, wherein a first electrode of the storage capacitor is configured to receive a data voltage, and a second electrode of the storage capacitor is electrically connected to the first node;

a third TFT, wherein a gate of the third TFT is configured to receive reset signals, a first end of the third TFT is configured to receive a reset voltage, and a second end of the third TFT is electrically connected to the first node;

a sixth TFT, wherein a gate of the sixth TFT is configured to receive enabling signals, and a first end of the sixth TFT is electrically connected the second node;

an OLED, wherein a positive end of the OLED is electrically connected to a second end of the sixth TFT, and a negative end of the OLED is loaded with a low potential voltage; and an elimination module being electrically connected to the first electrode of the storage capacitor and the first end of the driving TFT, wherein the elimination module is configured to receive the data voltage and the power supply voltage, and the elimination module, the third TFT, and the sixth TFT is cooperatively configured to eliminate a change of a driving current passing through the OLED, wherein the change is caused by a drift of a threshold voltage of the driving TFT.

13. The AMOLED display panel according to claim 12, wherein the scanning signals are configured to be the scanning signals at a n-th level, and "n" is an integral greater than or equal to 2.

14. The AMOLED display panel according to claim 13, wherein the elimination module comprises a fourth TFT and a fifth TFT, a gate of the fourth TFT is configured to receive reconfiguring signals, a first end of the fourth TFT is electrically connected to the first electrode of the storage capacitor, a second end of the fourth TFT is electrically connected to the first end of the driving TFT, a gate of the fifth TFT is configured to receive the scanning signals at a (n−1)-th level, a first end of the fifth TFT is configured to receive the data voltage, and a second end of the fifth TFT is electrically connected to the first electrode of the storage capacitor.

15. The AMOLED display panel according to claim 14, wherein the reconfiguring signals are configured to be the same with the scanning signals at the (n−1)-th level;

during a reset period, the third TFT and the fourth TFT are turned on, the first electrode of the storage capacitor is configured to store the power supply voltage, the second electrode of the storage capacitor is configured to store the reset voltage, and the driving TFT is turned on;

during a compensation voltage period, the fourth TFT and the switch TFT are turned on, and the driving TFT is turned off when a voltage difference between the gate and the first end of the driving TFT is equal to the threshold voltage;

during a writing period, the fifth TFT is turned on, and the data voltage is transmitted to the first electrode of the storage capacitor;

during an emitting period, the sixth TFT is turned on, and the OLED is configured to illuminate.

16. The AMOLED display panel according to claim 15, wherein the switch TFT, the driving TFT, the third TFT, the fifth TFT, and the sixth TFT are P-type TFTs, and the fourth TFT is a N-type TFT.

17. The AMOLED display panel according to claim 15, wherein the reset period, the compensation threshold voltage period, the writing period, and the emitting period are within one cycle of the OLED driving circuit.

18. The AMOLED display panel according to claim 14, wherein the elimination module comprises a seventh TFT and an eighth TFT, the first end of the driving TFT is configured to receive the power supply voltage via the seventh TFT, a gate of the seventh TFT is configured to receive the enabling signals, a first end of the seventh TFT is configured to receive the power supply voltage, a second end of the seventh TFT is electrically connected to the first end of the driving TFT, a gate of the eighth TFT is configured to receive the scanning signals at the n-th level, a first end of the eighth TFT is configured to receive a reference voltage, and a second end of the eighth TFT is electrically connected to the first end of the driving TFT.

19. The AMOLED display panel according to claim 18, wherein the reconfiguring signals are configured to be the enabling signals;

during a reset period, the third TFT and the fifth TFT are turned on, the first electrode of the storage capacitor is configured to store the data voltage, and the second electrode of the storage capacitor is configured to store the reset voltage;

during a compensation voltage period, the fifth TFT, the switch TFT, the driving TFT, and the eighth TFT are turned on, and the driving TFT is turned off when a voltage difference between the gate and the first end of the driving TFT is equal to the threshold voltage;

during a writing period and an emitting period, the seventh TFT, the fourth TFT, and the sixth TFT is turned on, and the OLED is configured to illuminate.

20. The AMOLED display panel according to claim 19, wherein the switch TFT, the driving TFT, the third TFT, the fourth TFT, the fifth TFT, the sixth TFT, the seventh TFT, and the eighth TFT are P-type TFTs.

* * * * *